United States Patent [19]

Lagsdin

[11] 4,201,137

[45] May 6, 1980

[54] SLED AND SLIDE CONSTRUCTION

[75] Inventor: Andry Lagsdin, Hanover, Mass.

[73] Assignee: American Zephyr Corporation, Intervale, N.H.

[21] Appl. No.: 892,988

[22] Filed: Apr. 3, 1978

[51] Int. Cl.[2] ..... A63G 21/04

[52] U.S. Cl. ..... 104/69; 104/119; 104/120; 104/134; 105/144; 105/145; 188/43

[58] Field of Search ..... 104/69, 53, 118, 119, 104/120, 246, 134; 105/141, 144, 145; 188/41, 42, 43

[56] References Cited

U.S. PATENT DOCUMENTS

| | | | |
|---|---|---|---|
| 395,736 | 1/1889 | Bullock | 188/43 |
| 1,537,204 | 5/1925 | Swartzbaugh | 188/43 |
| 1,852,384 | 4/1932 | Wallin | 104/69 |
| 2,731,922 | 1/1956 | Robb | 104/120 |
| 3,319,581 | 5/1967 | Churchman et al. | 104/119 |

FOREIGN PATENT DOCUMENTS

| | | | |
|---|---|---|---|
| 549695 | 1/1957 | Belgium | 104/120 |
| 88181 | 11/1959 | Denmark | 104/120 |

*Primary Examiner*—Joseph F. Peters, Jr.
*Assistant Examiner*—Ross Weaver
*Attorney, Agent, or Firm*—Wolf, Greenfield & Sacks

[57] ABSTRACT

A slide and sled combination designed for use on the side of a mountain in conjunction with the operation of ski lift, consists of a monorail extending the length of a mountain from the upper end near the top of a ski lift along a path containing curves, banked curves, and straight segments to the bottom of the mountain near the base of the ski lift. The monorail consists of, in cross-section, a tubular segment supported on a web. Sleds comprising shells are supported on and secured to the monorail by two sets of four wheels which engage the tubular segment. Each set of wheels are supported on bulkheads connected to the shell. A braking system controllable by an operator sitting in the shell includes brakes actuated by a lever that are adapted to engage the tubular segment at diametrically opposite points. Stabilizing wheels are provided on at least one of the bulkheads and are adapted to engage the web.

3 Claims, 5 Drawing Figures

SLED AND SLIDE CONSTRUCTION

SUBJECT MATTER OF INVENTION

The present invention relates to a sled and slide construction adapted for installation and use on the side of a mountain or the like.

BACKGROUND OF THE INVENTION

For many years, winter ski slope operators have encountered financial problems due in large measure to the winter seasonal nature of the ski business. Attempts to broaden the base of this seasonal business recently led to the development and installation in several localities of downhill slides. These downhill slides exemplified by the slides illustrated in U.S. Let. Pat. Nos. 3,973,785 and 3,858,517 in general have provided a chute-like apparatus which extends from the top of a mountain near the end of a ski lift to the bottom of a mountain near the other end of the ski lift. Sleds are carried up the ski lift with the riders. The riders then ride them down the chute which may be of any variable length.

While these rides have become quite popular and their use expanding they have certain inherent limitations. The sleds currently in use have braking systems which require frictional engagement between the brake component on the sled and the upper surface of the chute. These chutes, which are commonly made of asbestos containing material, lose their frictional properties when the surface of the chute becomes wet. It is therefore dangerous and in many instances impossible to use the chutes when they are wet. This in turn means the chutes cannot be used during the snow season or even during summers on rainy or damp days. Further, the chutes must be dried of dew each morning in order to render them safe. Even then there is an inherent danger if the chutes become wet for any reason at all.

Another limitation inherent in the chutes referred to above is that the sleds are not locked onto the chute, and, therefore, accidents can occur if the rider is careless and his sled leaves the chute. This in turn causes other problems in the operation of slides of this type. For example, if a rider leaves the chute or track, even though not hurt, there is an inherent danger when the rider tries to put the sled back on the track to complete his ride. Even if sufficient care is taken on reboarding the chute to avoid collisions with a subsequent rider, the entire system has to be slowed down to accommodate this reboarding.

Another problem common with the sled and slide of the type described is the requirement that the chutes must be built with inherent limitations on speed to prevent accidents. In the chutes currently in use, the speeds for which the chutes are designed are in general limited to an average of 8 to 10 miles an hour with upper speeds in the order of 12 miles an hour. In some instances, this speed may be exceeded but not by a great deal. The limitations of speeds to these magnitudes is required because these sleds and chutes are used by a wide variety of riders, including children and adults of variable competency.

Another problem inherent in the prior art relates to the specific configuration of the brakes. In systems heretofore in use, the braking system can be a cumbersome and heavy arrangement that is not certain in operation.

Attempts have been made to design slides or chutes of different constructions, but insofar as known, these other slides and chutes at least have some of the inherent limitations of slides and chutes discussed above.

SUMMARY OF THE INVENTION

It is an object of the present invention to overcome many of the limitations of the sled and slide described above. Thus, an object of the present invention is to provide a sled and slide combination adapted for use on a ski slope in conjuction with the operation of a ski lift. In the persent invention, sleds having braking systems partially controlled by the operator are locked to a monorail system for the length of travel down the monorail.

The rider is belted onto the sled so that neither the rider nor the sled can leave the monorail. In addition to braking systems partially controlled by the operator, the braking system provides an improved configuration that is not susceptible to failure when the chute is wet. The braking system further provides a failsafe system which is lightweight in arrangement and configuration and which is designed specifically to engage diametrically opposite portions of the tubular segment of the monorail in a manner which provides maximum control and engagement of the brake.

A further object of the present invention is to provide a relatively stable arrangement of sled and monorail in which the sled is supported at its forward and rear ends by four rollers radially arranged about the tubular segment of the monorail with each of these sets of four rollers supported on a bulkhead, in turn secured to the shell of the sled.

A further object of the present invention is to provide a slide and sled combination having a braking system designed to permit operation of the sled at high speed with comparative safety since the braking system may be used to stop the sled with ease and certainty.

A further object of the present invention is to provide a sled construction which is simple and safe to operate, which is cmoparatively sturdy, easy to manufacture and maintain and is comparatively inexpensive to manufacture.

In the present invention, there is provided a sled for use on a monorail slide with the monorail slide having a cross-sectional configuration in the form of at least a segment of a tubular member and a web extending from the tubular member. The sled comprises a shell having a pair of wheel means located at opposite ends of the shell. Means secure the wheel means to the shell and also support brake means having brake pads. The support means for the brakes position the brake pads to operatively engage the tubular means when a controlled lever on the sled is moved. The wheel means each consist of four radially arranged wheels designed to engage the tubular member.

DETAILED DESCRIPTION OF THE DRAWINGS

The foregoing objects and advantages of the present invention will be more clearly understood when considered in conjunction with the accompanying drawings in which.

DETAILED DESCRIPTION OF INVENTION

Figure 2:
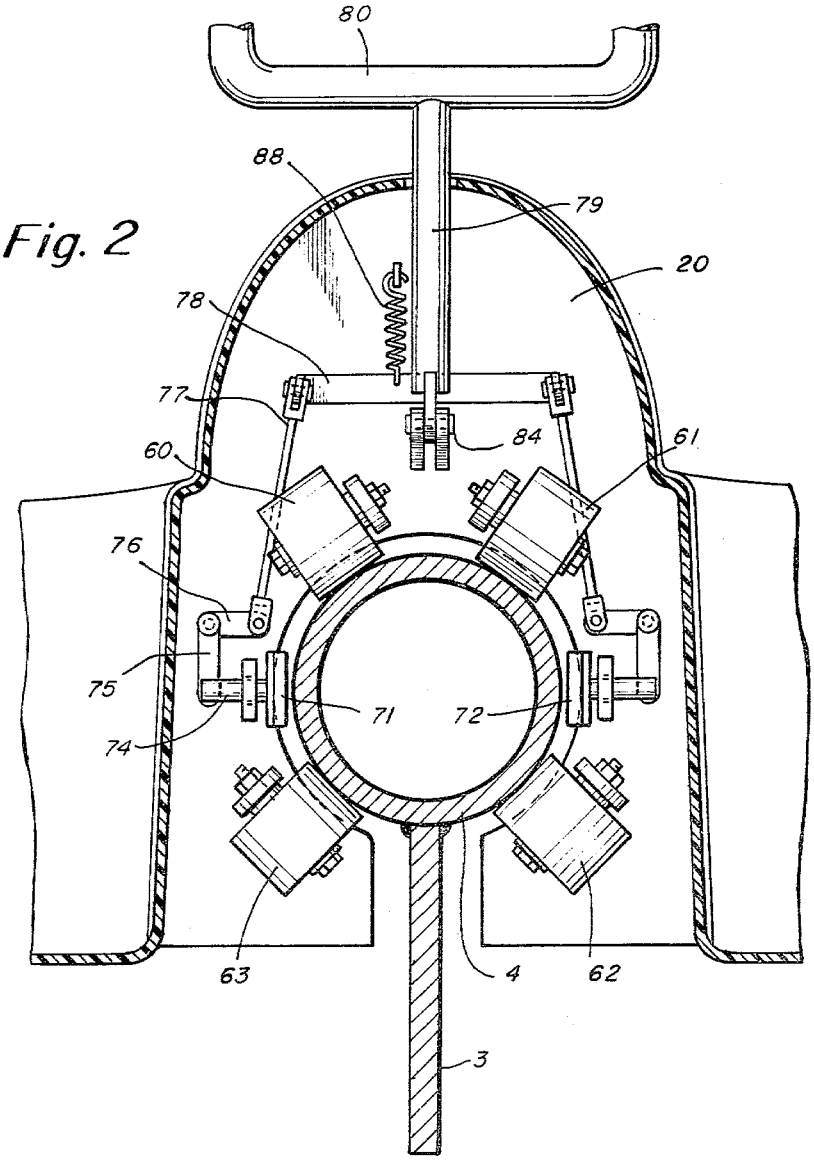
FIG. 2 is a cross-sectional view taken along line 2—2 of FIG. 1.
Figure 3:
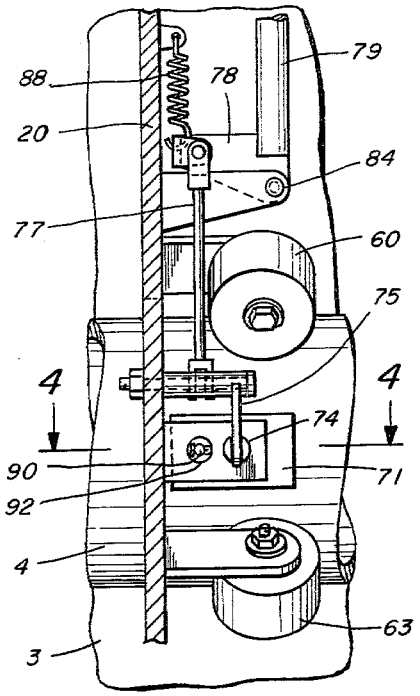
FIG. 3 is a cross-sectional detail of a segment illustrated in FIG. 2 and looking from the left side thereof.

Referring to the drawings, there is illustrated a sled 1 supported on a monorail system 2. The monorail system 2 is shown only in a short segment, but in actual practice, may consist of a continuing member of sections butted end to end over a span of thousands of feet. Thus, for example, a monorail system typically will be positioned on a mountain extending downwardly from the top to the bottom. The monorail is suitably supported by stanchions or supports not forming a portion of this invention. These stanchions and supports suitably secure the monorail in a position as illustrated in FIG. 2 above the ground a suitable distance as, for example, one to two feet. The supports may comprise brackets secured at the lower edge of web 3 which in turn supports the tubular member 4. The stanchions or supports which engage the web 3 should be sufficiently low as not to interfere with the movement of the various components hereafter described.

The monorail system may consist of both straight, curved, and banked curved sections. Typically, the tubular member 4 has a diameter of 4 inches, while the web 3 has a height of approximately 5 or 6 inches. The segments of monorail sections comprising the web 3 and tubular member 4 may be of any suitable length as, for example, in 20 foot lengths. These segments are suitably butted end to end to form a serpentine-like monorail extending form the top of the mountain downwardly. In curved sections of the monorail, curves should be of sufficient radius as not to interfere with the downward movement of the sleds as hereafter described.

The shell 1 is provided with a seat section 5 upon which a rider may sit and a pair of well sections 6 on either side of an elongated fold 7. The fold 7 is of sufficient height and radius to extend over the tubular member 4 of the slide with the well sections 6 positioned on either side thereof to accommodate the rider's foot. A suitable skirt 8 extends symmetrically on both slides of the sled. A front hood 9 covers the monorail section and is formed with an opening 10 at its forward end through which the monorail may freely pass. A similar opening, not shown, is at the back end of the sled and is designed to allow free passage of the sled at its rear over the monorail. Suitable bumpers of rubber or other material may be provided at the front end as illustrated at 11 and at the rear end as illustrated at 12.

A pair of bulkheads 20 and 21 are positioned respectively at the forward and rear ends within the shell. These bulkheads are designed to support wheel and braking members of the sled. The bulkheads are suitably secured to the inner periphery of the shell by cement or, if desired, by suitable riveting techniques.

The rear bulkhead 21 is formed with a keyhole-like opening 25. This keyhole-like opening provides a circular portion through which the tubular member 4 freely passes and a lower section 26 through which the web 3 freely passes. A set of wheels are suitably journaled on the web 21. This set of wheels comprising the upper pair 30, 31 and the lower pair 32, 33 are suitably journaled with their axes normal to radii from the center of the tubular member. Each of the rollers 31 through 33, inclusive, is suitably journaled on a support 38, in turn, secured to the bulkhead 21. The surfaces of the wheels or rollers 30 through 33, inclusive, are tangential to the outer surface 42 of the tubular member 4. If desired, these wheels may be provided with spring-loaded means designed to normally force the wheels against the outer surface of the tubular member 4. These four wheels are designed to support the rear end of the sled on the monorail.

A pair of stabilizer wheels 51, 52 are suitably supported in journals, in turn, secured to the bulkhead 21, with the axis of each of the wheels 51, 52 parallel to web 3. The surfaces, however, of rolls 51 and 52 should be spaced slightly from the opposite surfaces of web 3 so that the web may pass between rollers 51 and 52 with narrow but not a touching clearance.

The bulkhead 22 also supports four wheels 60 through 63, inclusive. These wheels may be secured on bearing supports similar to that described in conjunction with the wheels secured to bulkhead 21. The axes of the wheels 60 through 63, inclusive are arranged so that the surfaces of their respective wheels normally engage the outer surface of tubular member 4. Preferably the wheels 60 through 63 as with the case of the wheels 30 through 33 are spaced equidistant around the tubular member 4.

Figure 1:
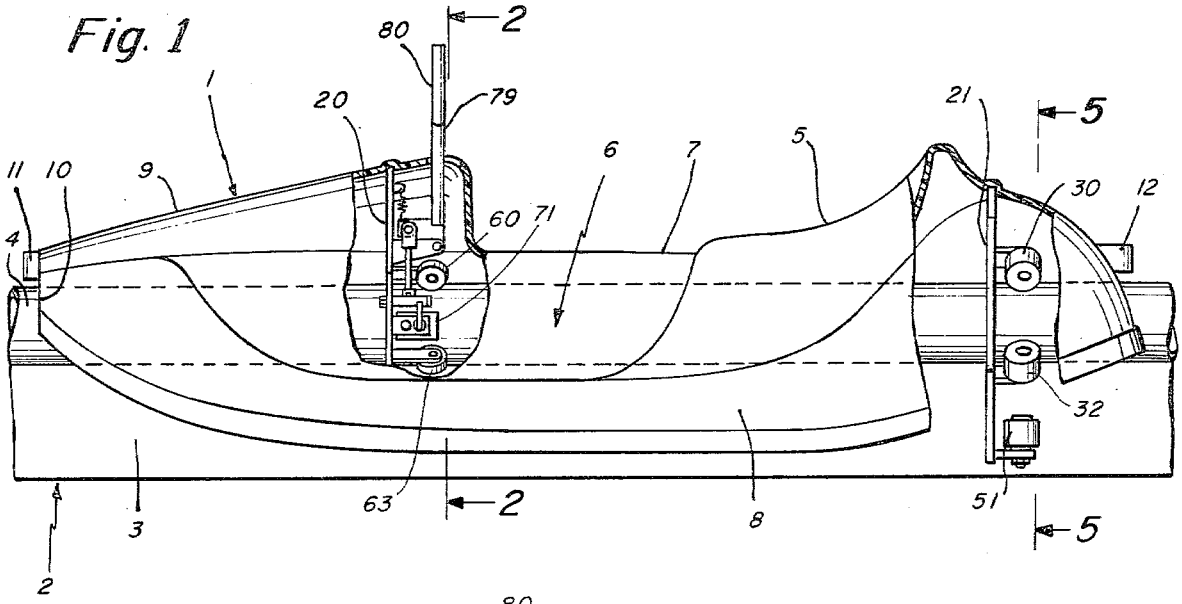
FIG. 1 is a partially cross-sectioned elevational view of a monorail segment having a sled positioned thereon.

A braking system is also supported on the forward bulkhead 20. This braking system includes a pair of brake pads 71 and 72 positioned by support means for opposite clamping action against the tubular member at diametrically opposite portions thereof. Preferably the brake pads 71 and 72 engage the tubular member 4 at points along its horizontal axes. The brake pads 71 and 72 are in turn supported on a suitable support. This arrangement may include a shaft 74 (FIG. 4) in turn pivotally secured at its free end to link 75. Link 75 in turn is pivotally connected through length 76 to arm 77. Arm 77 in turn is pivotally engaged at its lower end to link 76 and its upper end to lever 78. Lever 78, an L-shaped member, is in turn connected to the operator's handle 79 which extends outwardly through the top of the shell cowling as best illustrated in FIGS. 1 and 2. The control lever 79 may be provided with suitable upper portion including, for example, the handle 80.

The operating lever 79 is pivotally supported on pivot 84, thus permitting the handle 79 when pulled rearwardly as viewed in FIG. 1 to move lever 78 upwardly in turn causing the simultaneous and symmetrical upward movement of the link 77 through a chain in which the brake pads 71 and 72 will move inwardly at a uniform rate. The braking system is spring loaded to a vertical position by spring 88 which engages at one end a pin on the bulkhead 20 and at the other in the lever 78. This arrangement normally maintains the lever in an inoperative or neutral position when the operating lever is vertical.

Figure 4:
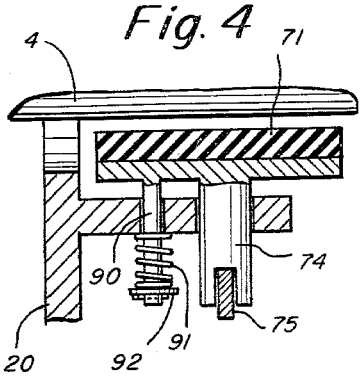
FIG. 4 is a cross-sectional detail taken along the line 4—4 of FIG. 3.
Figure 5:
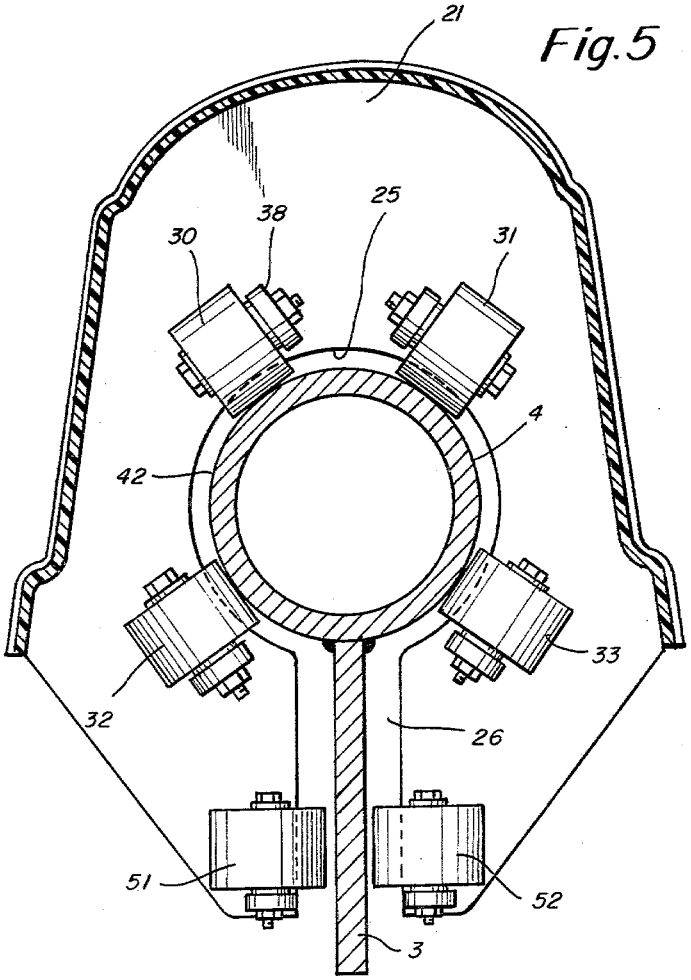
FIG. 5 is a cross-sectional view taken on an enlarged scale on the line 5—5 of FIG. 1.

The brake pads are normally maintained in a non-engaging position by a spring arrangement illustrated in FIG. 4. The brake shoe carrying brake pad 71 has a shaft 90 extending from it through the flange extending from the bulkhead 22. A spring 91 engages this flange at one end and washer 92, keyed to shaft 90, at the other end. This spring 91 coaxial with shaft 90 normally maintains the pad in a non-operative position.

What is claimed is:

1. A sled for use on a monorail slide, the rail having a cross-sectional configuration in the form of at least a segment of a tubular member and a web extending from said tubular member, comprising a shell, said shell having a passenger seat intermediate its ends, forward and rear bulkheads each having its periphery secured to the inner surface of said shell, a pair of wheel means, said wheel means each comprising a plurality of radially arranged wheels supporting and guiding said shell on said monorail, means supporting one of said wheel means on the forward and the other wheel means on the rear bulkheads, brake means having brake pads, means supporting said brake means on said forward bulkhead with said brake pads positioned forward of said seat to operatively engage said tubular member intermediate said wheels of said wheel means on said forward bulkhead, said brake means including an operating lever and a pair of lever linkages commonly controlled by said operating lever and each operatively connected to said brake pad.

2. A sled set forth in claim 1 wherein said wheel means each include four wheels and means supporting said wheels for rotation on axes normal to radii from the axes of said tubular member.

3. A sled as set forth in claim 2 wherein said bulkheads each are formed with segments extending below said tubular member with an aperture forming a keyhole through which said monorail extends, additional wheels engaging said web below said tubular member and supported on said segments of said rear bulkhead.

* * * * *